US006368667B1

(12) United States Patent
Burazin et al.

(10) Patent No.: US 6,368,667 B1
(45) Date of Patent: Apr. 9, 2002

(54) MASKING PATTERNS TO ENHANCE APPARENT OPACITY OF PAPER PRODUCTS

(75) Inventors: Mark A. Burazin; Jeffrey D. Lindsay, both of Appleton; Roger Edward Wendler, Jr., Sherwood, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/468,502

(22) Filed: Dec. 21, 1999

Related U.S. Application Data

(60) Provisional application No. 60/114,237, filed on Dec. 30, 1998.

(51) Int. Cl.[7] ..... B05D 5/06

(52) U.S. Cl. ..... 427/288; 427/256

(58) Field of Search ..... 427/8, 256, 258, 427/261, 262, 267, 276, 288; 8/500, 919; 101/120, 211, 192, 494

(56) References Cited

U.S. PATENT DOCUMENTS

| | | | | |
|---|---|---|---|---|
| 2,380,047 | A | * | 7/1945 | Hyman |
| 2,649,386 | A | * | 8/1953 | Snowman, Jr. |
| 4,126,727 | A | | 11/1978 | Kaminski |
| 4,409,280 | A | | 10/1983 | Wiley et al. |
| 4,761,205 | A | | 8/1988 | Crane |
| 4,796,921 | A | | 1/1989 | Neiman |
| 5,019,202 | A | | 5/1991 | Kawahata et al. |
| 5,161,829 | A | | 11/1992 | Detrick et al. |
| 5,209,953 | A | * | 5/1993 | Grupe et al. |
| 5,213,664 | A | | 5/1993 | Hansell |
| 5,246,546 | A | | 9/1993 | Ampulski |
| 5,449,200 | A | | 9/1995 | Andric et al. |
| 5,614,293 | A | | 3/1997 | Krzysik et al. |
| 5,776,306 | A | | 7/1998 | Hepford |
| 5,824,399 | A | | 10/1998 | Denton et al. |
| 6,067,504 | A | | 5/2000 | MacFarlane |

OTHER PUBLICATIONS

Instruction manual for the Technibrite Micro TB–1C, 1995, § 4.15–5.10.

Fred W. Billmeyer, Jr. and Max Saltzman, Principles of Color Technology, 2nd ed., New York,: John Wiley and Sons, 1981, pp. 57–63,83.

Article "Color" by Kurt Nassau in the Kirk–Othmer Encyclopedia of Chemical Technology, vol. 6, 1993, pp. 855–858.

Richard A. Hunter, "The Measurement of Appearance", John Wiley & Sons, 1975, pp. 106–107, 122–123.

* cited by examiner

*Primary Examiner*—Fred J. Parker
(74) *Attorney, Agent, or Firm*—Brinks Hofer Gilson & Lione

(57) ABSTRACT

The present invention is directed to a paper product that is printed with a masking pattern. The masking pattern is such that it is not discernible on the paper product, yet is heavy enough to obscure objects which may appear behind the product to the eye of the consumer. In this manner, the consumer perceives the paper product to have a greater opacity than the product actually has, and thereby the consumer is not misled to assume the absorbency and/or strength of the paper product is less than is actually the case.

5 Claims, 1 Drawing Sheet

MASKING PATTERNS TO ENHANCE APPARENT OPACITY OF PAPER PRODUCTS

RELATED APPLICATION

This application is based on Provisional Application Ser. No. 60/114,237 filed Dec. 30, 1998, which is incorporated herein by reference.

FIELD OF THE INVENTION

The present invention is directed to a paper product, and more particularly, to a paper product that is printed with inks in certain masking patterns to enhance the consumer's perceived opacity of the paper product.

BACKGROUND OF THE INVENTION

There are a variety of paper products including, for example, tissues, towels, wipers and the like. There are also a variety of methods of manufacturing paper products including, for example, a wet-laid product that may or may not be creped or a through-airdried product.

Traditionally, many paper products have been made using a wet-pressing process in which a significant amount of water is removed from a wet-laid web by pressing or squeezing water from the web prior to final drying. In particular, while supported by an absorbent papermaking felt, the web is squeezed between the felt and the surface of a rotating heated cylinder, such as a Yankee dryer, using a pressure roll as the web is transferred to the surface of the Yankee dryer. The dried web is then dislodged from the Yankee dryer with a doctor blade, which is known as creping. Creping serves to partially debond the dried web by breaking many of the bonds previously formed during the web-pressing stages of the process. The web may be creped dry or wet. Creping can greatly improve the feel of the web, but at the expense of a significant loss in strength.

A creping method is disclosed in U.S. Pat. No. 3,879,257, issued to Gentile et al. and assigned to the Scott Paper Company (1975), entitled "Absorbent Unitary Laminate-Like Fibrous Webs and Method for Producing Them," herein incorporated by reference. The Gentile et al. patent discloses a process of creping a base sheet, then printing a binder on one side of the base sheet, creping the base sheet again, then printing a binder on the other side of the base sheet, and then creping the base sheet a third time.

More recently, throughdrying has become an alternate means of drying paper webs. Throughdrying provides a relatively noncompressive method of removing water from the web by passing hot air through the web until it is dry. More specifically, a wet-laid web is transferred from a forming fabric to a coarse, highly permeable throughdrying fabric and retained on the throughdrying fabric until fairly dry. The resulting throughdried web is softer and bulkier than a conventionally dried creped sheet because fewer bonds are formed and because the web is less compressed. Squeezing water from the wet web is eliminated, although the use of a pressure roll to subsequently transfer the web to a Yankee dryer for creping may still be used.

The paper product itself typically has a background pattern. The background pattern imparts to the paper product a textured look and feel to the user.

Absorbency and/or strength of paper products are judged by consumers by several means including their apparent opacity. In the past, absorbency and/or strength have had some connection to opacity. This connection has been broken by recent technology.

Recent technology can produce paper products such as tissues that are more translucent or less opaque, but which are more absorbent and possess more strength than more opaque paper products. This is especially true of paper products made with the through-air drying process.

For example, because of current improvements in manufacturing paper products using the uncreped through-air drying process, paper products are being produced with less fiber material, i.e., with fewer plies and/or less basis weight. Because there is less fiber material, products are becoming more translucent or less opaque to the user or consumer. This may be problematic because, if the user sees through a paper product that is more translucent or less opaque, the user may believe, incorrectly, that paper products with less plies and smaller basis weights are not as absorbent and/or strong as products with more plies and more basis weight.

SUMMARY OF THE INVENTION

The present invention is directed to a paper product that is printed with a masking pattern. The masking pattern is such that it is not readily discernible against the background pattern printed on the paper product, yet obscures objects which may appear behind the product relative to the eye of the consumer. In this manner, the consumer perceives the paper product to have a greater opacity than the product actually has, and thereby is not misled as to its absorbency and strength.

These and other objects, advantages, and features of the present invention will be better understood upon review of the following detailed description of the preferred embodiments.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings.

DETAILED DESCRIPTION OF THE INVENTION

Figure 1:
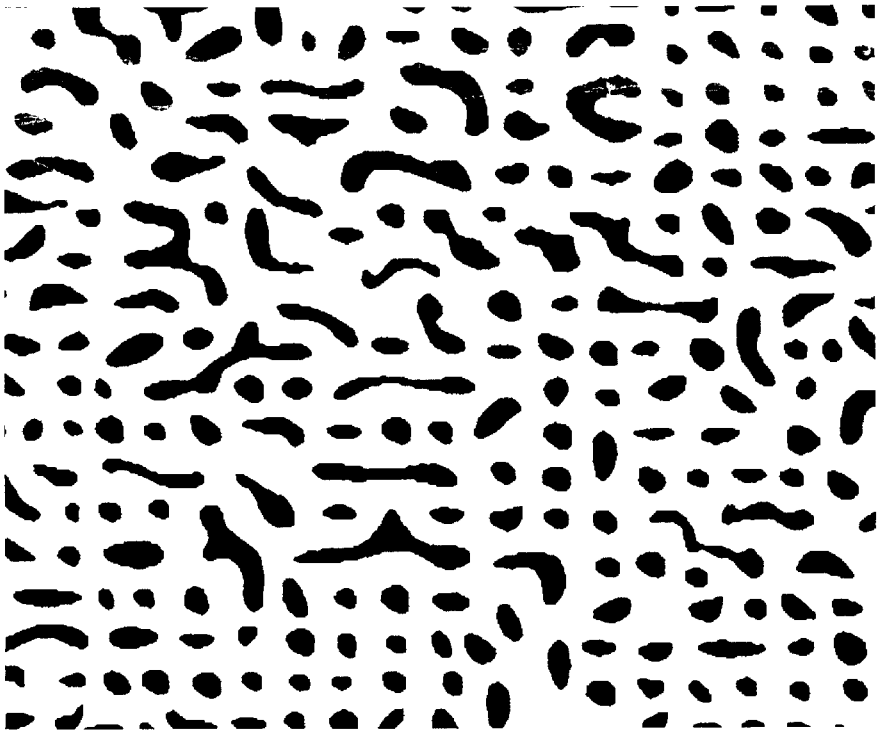
FIG. 1 is a plan view of a facial tissue printed with one embodiment of a masking pattern.

The present invention is directed to a paper product that is printed with a masking pattern. The masking pattern is such that it is not readily discernible relative to the background pattern of the product but obscures objects behind the product. In this manner, the consumer believes that the product has a greater opacity than it really does, signaling to the customer the thickness, absorbency and strength that the product actually has.

Suitable cellulose fibers for use in connection with this invention include predominately hardwood and softwood virgin papermaking fibers. Non-cellulose synthetic fibers or recycled fibers can also be used. The paper can be plied together to form a multi-ply product having two, three or more plies per sheet of paper product. The basis weight of the multi-ply products of this invention depends upon the number of plies and the basis weight of each ply. By way of example, the finished basis weight is usually less than about 60 grams per square meter ($g/m^2$), more specifically less than about 40 $g/m^2$, most specifically less than about 30 g/m$^2$. A most specific basis weight range is in the range from about 15 to 30 g/m$^2$. Generally, lower basis weight products have lower opacity. Additionally, the individual plies can be layered or blended (homogenous).

The paper product of the present invention is made by any conventional process including, for example, through-airdrying or wet-laying the product. The paper sheet may be through-airdried according to any of the following patents: U.S. Pat. No. 5,593,545, issued to Rugowski et al. (1997) entitled "Method for Making Uncreped Throughdried Tissue Products without an Open Draw," U.S. Pat. No. 5,591,309, issued to Rugowski et al. (1997) entitled "Papermaking Machine for Making Uncreped Throughdried Tissue Sheets," U.S. Pat. No. 5,667,636, issued to Engel et al. (1997) entitled "Method of Making Smooth Uncreped Throughdried Sheets;" U.S. Pat. No. 5,048,589, issued to Cook et al. (1991) entitled "Non-Creped Hand or Wiper Towel;" U.S. Pat. No. 5,932,068 issued to Farrington Jr., et al. entitled "Soft Tissue;" and U.S. Pat. No. 5,746,887 issued to Wendt et al. entitled "Method of Making Soft Tissue Products," which are all herein incorporated by reference.

The invention is particularly applicable to paper products having opacities prior to printing with a masking pattern less than about 70%, more particularly less than about 65%, even more particularly less than about 60%, and most particularly less than about 55%.

In accordance with the present invention, the paper product is printed with at least one masking pattern to achieve an increased perceived opacity by the consumer. The printing of the masking pattern may or may not also achieve an actual increase in measured opacity compared to a sheet not printed with the masking pattern.

In particular, the masking pattern obscures or camouflages items behind the paper sheet to enhance the user's perceived opacity of the sheet. In other words, if the user places his or her hand behind the sheet, the printing of the masking pattern obscures the user's hand from his or her view through the sheet. In this manner, the user will not be confused or misled as to the absorbency and/or strength.

Any particular masking pattern may be used to print the masking pattern for perceived opacity. The entire sheet may be printed with the masking pattern or only a portion of the sheet may be printed. Thus, 100% of the sheet may be printed with the masking pattern, or a percentage less than 100% of the sheet may be printed.

Figure 2:
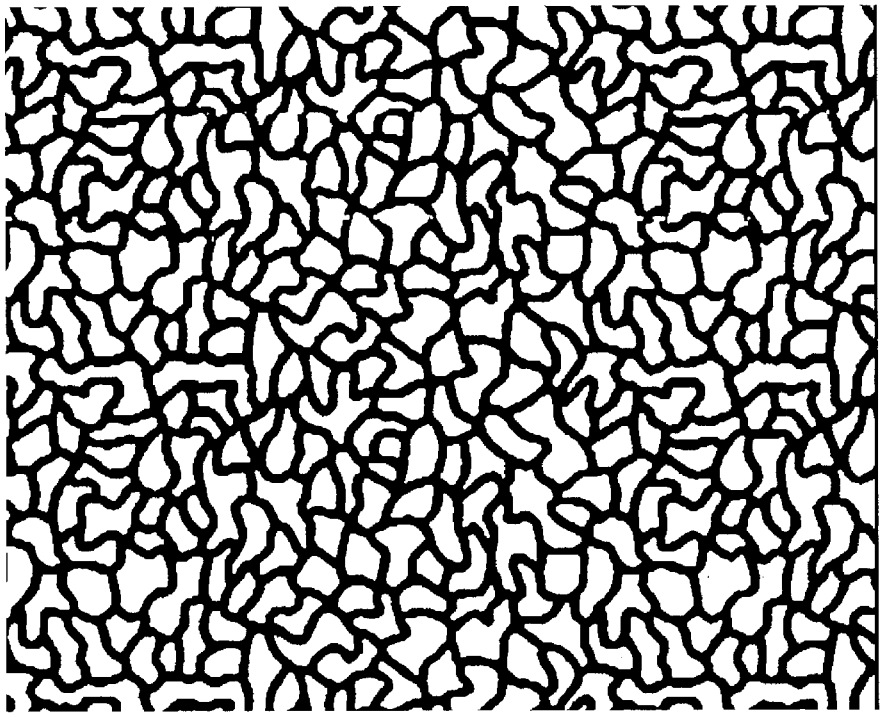
FIG. 2 is a plan view of facial tissue printed with an alternative embodiment of masking pattern.

Suitable masking patterns for purposes of this invention are patterns that appear random to the naked eye and comprise a variety of colored elements of different shapes and sizes. These patterns can include a multiplicity of distinct colored elements, such as shown in FIG. 1. The patterns can also include a multiplicity of non-colored elements defined by irregular colored lines, as shown in FIG. 2. The patterns can also include combinations of patterns of the types shown in FIGS. 1 and 2.

The size of the elements are such that they effectively camouflage the users and/or fingers when the tissue is being handled. Therefore, the majority of the elements can have an equivalent diameter of about the width of a finger or less and should include at least two or more sizes, with many different sizes being preferred. More specifically, the equivalent diameter of the majority of the elements can be about 26 mm or less, more specifically about 18 mm or less, and still more specifically about 13 mm or less.

The colors of the masking pattern and the base paper as used herein are characterized by the HunterLab color scale obtained from a Technibrite Micro TB-1C tester. The values L, a, and b are the results obtained from the meter readings and following the directions in the manual which accompanies the instrument.

Preferably, the ink color of the masking pattern is close to the color of the base paper product thereby making the masking pattern less noticeable or discernible to the user. More specifically, the color of the ink (i.e., the measured color of the printed areas of the tissue) is intermediate to the color of the hand and the color of the unprinted tissue. In a related embodiment, the Hunter "a" and "b" values of the printed tissue are intermediate to the respective values of the hand and the unprinted tissue, while the Hunter "L" value can be either intermediate to those of the hand and the unprinted tissue, or higher than the L value of the unprinted tissue. In this manner, the paper product and the masking pattern imparts a two-color camouflage to the sheet, the two colors being the color of the sheet (typically white) and the color of the ink. In related embodiments, a plurality of masking patterns and ink colors are used which can either overlap or not overlap. Overlapping printed regions from two ink colors can create an apparent third ink color, which may further enhance the masking or camouflage effect. Inks may be printed with uniform or varying ink density. With varying ink density, printed areas may display a range of apparent colors even though a single ink is used, which can further enhance the masking effect.

By ink is meant any flowable liquid, dispersion, or slurry suitable for printing that will impart a color to or dye the paper product. Preferably, the ink is water based, but in some applications solvent based inks may be desirable. Other than containing color, the ink may contain additives, coatings and fillers, such as titanium dioxide, calcium carbonate, or talc for purposes other than masking. Additives may include starch, Kymene, silicone, or germicides. The addition of additives, coatings and fillers also may be desirable for imparting opacity, as well as other properties to the paper product.

The viscosity of the ink generally is in the range from about 50 to 30,000 centipoise, more specifically from about 500 to 5,000 centipoise, most specifically from about 200 to 5,000 centipoise. For some printing technologies, low viscosity inks may be suitable, for example, from about 5 to 500 centipoise.

After the sheet is printed, the sheet may be tested to determine whether its perceived or measured opacity has actually increased with the masking pattern. Additionally, the sheet may be tested to determine whether its perceived or measured translucency is changed with the printing of the masking pattern.

Preferably the color of the ink is characterized by the HunterLab Color Scale, a scale has three parameters: L, a and b. Given these parameters, the ink manufacturer can design the desired color of ink. What is important is the color of the ink as printed on the particular paper product, not necessarily the color of the ink as supplied by the manufacturer or as printed on "standard" substrates. Those skilled in the art will be able to select an appropriate ink to give the desired color values as printed, though a few routine iterations may be needed to adjust ink color and print density to obtain the desired result.

Desirably, the ink as printed on the tissue is not readily discernible to the user, and in particular is not readily discernible in ordinary indoor incandescent lighting when vertically oriented at eye level at a distance of 3 feet from the user.

The HunterLab Color Scale of Hunter Associates Laboratory, Inc., 11491 Sunset Hills Road, Reston, Va., U.S.A. is described and explained in the following publications:

http://www.hunterlab.com/ http://fdir.derby.ac.uk/colour/finfo/glossary/h/HunterLabUCS.html http://www.colorpro.com/info/tools/convert.htm http://cfshoemaker.ucdavis.edu/RiceDay/Hunter.htm In accordance with one embodiment of the present invention the range of colors for the ink as printed on the paper product ($L_{ink}$, $a_{ink}$, $b_{ink}$) is chosen by the following formulas:

$$L_{ink}=L_{tissue}+C1(L_{hand}-L_{tissue})$$

$$a_{ink}=a_{tissue}+C2(a_{hand}-a_{tissue})$$

$$b_{ink}=b_{tissue}+C3(b_{hand}-b_{tissue})$$

wherein $L_{tissue}$ and $L_{hand}$ are meter measurements of at least one paper product and at least one hand reading respectively; wherein $a_{tissue}$ and $a_{hand}$ are meter measurements of at least one paper product and at least one hand reading respectively; wherein $b_{tissue}$ and $b_{hand}$ are meter measurements of at least one paper product and at least one hand reading respectively; wherein C1 for a specific ink is in the range from about −0.5 to about 1, and C2 and C3 is each in the range from 0 and about 1, more specifically wherein C1, C2 and C3 is each in the range from about 0 to about 1, more specifically in the range from about 0 and 0.75, more specifically in the range from about 0 and 0.5, and most specifically in the range from about 0.25 and 0.5.

The values in the above formula for $L_{tissue}$, $L_{hand}$, $a_{tissue}$, $a_{hand}$, $b_{tissue}$, and $b_{hand}$ may be determined by taking readings of the hand and tissue using a tester, for example, by using the Technibrite Micro TB-1C tester for brightness, color, opacity and fluorescence made by Technidyne Corporation, New Albany, Indiana, U.S.A. Persons skilled in the field will realize that it may be desirable to measure more than one sample of the paper product and/or the hand and to average the results separately to paper samples and the hand readings.

When measuring $L_{tissue}$, $a_{tissue}$, $b_{tissue}$, a stack composed of a sufficient number of sheets of paper product is used so that no light shines through and there is no noticeable change in readings when additional sheets are added. Typically 16 sheets suffice. Measuring $L_{tissue}$, $a_{tissue}$, $b_{tissue}$ in this fashion corresponds to the color of a wound roll of the unprinted paper product.

Alternately, $L_{tissue}$, $a_{tissue}$, and $b_{tissue}$, are measured for a single sheet of finished product, meaning a single sheet of one-ply of tissue is used for one-ply products, or, for multi-ply products, a single sheet comprising the same number of plies contained in the finished product (typically 2 plies, though 3 and 4 ply products are also found in the market place). The sheet to be measured is placed on the flat black backing disk that comes with the Technibrite Micro TB-1C test device and measured in the normal manner for L-a-b data. Measuring $L_{tissue}$, $a_{tissue}$, $b_{tissue}$ in this fashion corresponds to the color between the spread out fingers of a hand covered with a single sheet of unprinted finished product. For hand measurements, the palm of the hand is placed flush against the opening of the light source, just as tissue samples are placed flush against that opening during measurement.

In an alternate embodiment, $L_{ink}$ is made greater than $L_{tissue}$ by adding a positive constant "W" ranging from 0 to about 15, more specifically from about 0 to about 12, and most specifically from about 2 to about 10. By way of example, typical white tissue can have $L_{tissue}$ values, when measured as a single sheet on a black backing (which generally gives similar results to measurement with no backing at all), of about 70 to about 80. When a second sheet is added, the measured L value can increase by about 10 points. Adding additional sheets may elevate the measured L value to between 90 and 100, depending on the nature of the fibers. Thus, for single-ply tissues, for example, one approach to masking may be to create printed regions having an L value similar to or intermediate to that obtained when an additional sheet is beneath the first sheet of tissue. Thus, a useful strategy can be to create printed regions having L values greater than that of the tissue, according to the previously stated ranges.

In this embodiment, ($L_{ink}$, $a_{ink}$, $b_{ink}$) can be chosen by the following formulas:

$$L_{ink}=L_{tissue}+W$$

$$a_{ink}=a_{tissue}+C2(a_{hand}-a_{tissue})$$

$$b_{ink}=b_{tissue}+C3(b_{hand}-b_{tissue})$$

where W is in the range from 0 to about 15, more specifically from about 0 to about 12, and most specifically from about 2 to about 10, and C2 and C3 are as previously defined.

In yet another embodiment, the color of the printed regions of the tissue is selected to be intermediate to measured color values for the unprinted tissue and the unprinted tissue placed on a hand. This strategy can also be successful in defining masking values, and while it gives similar results to the strategies previously discussed, can take into account optical reactions of the tissue with an underlying hand, which may be affected by the topography of the tissue and how closely it can lie against the skin of a user. In this approach, a sheet of tissue is placed on the palm of the hand and the palm is then placed against the optical opening of the test device for measurement, yielding L-a-b values that will desirable defined herein as ($L_{h+t}$, $a_{h+t}$, $b_{h+t}$). In this embodiment, the color of the printed regions of the tissue is selected according to:

$$L_{ink}=L_{tissue}+C4(L_{h+t}-L_{tissue})$$

$$a_{ink}=a_{tissue}+C5(a_{h+t}-a_{tissue})$$

$$b_{ink}=b_{tissue}+C6(b_{h+t}-b_{tissue})$$

wherein C4 for a specific ink is in the range from about −0.5 to about 1, and C5 and C6 is each in the range from 0 and about 1, more specifically wherein C4, C5, and C6 is each in the range from about 0 to about 1, more specifically in the range from about 0 and 0.75, more specifically in the range from about 0 and 0.5, and most specifically in the range from about 0.25 and 0.5.

The following example is given in order to further illustrate the invention, and not as a limitation thereof.

EXAMPLE

Using the Technibrite Micro TB-1C tester mentioned above (hereinafter the "Tester"), the values for L, a and b were obtained for a single facial tissue. The values obtained were for: $L_{tissue}$, $a_{tissue}$ and $b_{tissue}$.

Using the same Tester, the L, a and b readings were obtained of the palm of the hand of a Caucasian person. The hand measurements were repeated several times and averaged. The average values obtained were for: $L_{hand}$, $a_{hand}$, and $b_{hand}$.

The values obtained with the Tester were used to calculate $L_{ink}$, $a_{ink}$, and $b_{ink}$ employing the formulas above using different values of C.

An ink was made from values obtained, and printed on a facial tissue in patterns shown in FIGS. 1 and 2.

It is a discovery of the invention that values of C from 0 to 1, preferably from 0 to 0.75, more preferably from 0 to 0.5, and desirably from 0.25 to 0.5 give the desired apparent opacity without being readily discernible.

Although the above Example employed a facial tissue, the invention preferably may be used on all types of paper products that otherwise may be at least partially translucent. Examples of such paper products include facial tissue, bath tissue, napkins, towels and other paper sheets made using a through airdried process.

Moreover, while the readings of palm of the hand were taken of a Caucasian person, readings of other ethnic groups may be used, or readings of different ethnic groups may be taken and averaged. While the readings were taken successfully of the palm of the hand, it may be advantageous to take readings of other portions of the hand, such as the fingers or combination of portions of the palm and fingers.

Using the Technibrite Micro TB-1C tester, measurement of L, a, and b were obtained of the hands of people with differing ethnic backgrounds: Two were Caucasians of Northern European ancestry, two with Chinese ancestry, one from the Indian subcontinent, one from Nigeria, and one from the Middle East. The values of the hand measurements for the different backgrounds are shown in the following table.

TABLE

| | Europe I | Europe II | China I | China II | India | Africa | South Amer. | Middle East |
|---|---|---|---|---|---|---|---|---|
| $L_{hand}$ | 55.13 | 61.8 | 53.63 | 54.16 | 48.45 | 40.49 | 54.03 | 54.11 |
| $a_{hand}$ | 6.3 | 11.87 | 12.6 | 10.29 | 10.48 | 11.93 | 13.8 | 15.47 |
| $b_{hand}$ | 14.75 | 13.19 | 11.82 | 13.28 | 12.93 | 11.93 | 13.19 | 14.01 |

It will be noted that the values of the hand measurements in the above Table were within the following ranges: $L_{hand}$ from about 40 to 62; $a_{hand}$ from about 6 to 16; and $b_{hand}$ from about 12 to 15.

Generally, for a sheet of two-ply product, for example, a facial tissue, one or both of the plies is printed with the masking pattern before the plies are plied together. In the alternative, the two-ply product may be printed with the masking pattern after the plies have been plied together.

Utilizing the colors of inks for the masking pattern in the ranges described above, the sheet is printed in any conventional manner. For example, printing may be by rotary grauvre, flexographics, ink-jet, offset, lithographics, spray, and the like.

The masking pattern may be printed with two or more inks or pigments, such as first printing with one ink having a color intermediate to the color of the palm of the human hand and the color of the unprinted tissue, and a second printing with a second ink comprising, for example, white pigments to give tissue printed with the second ink an $L_{tissue}$ value greater than the $L_{tissue}$ value of the tissue before any printing. In this manner, the tissue is printed with an ink having a color between that of the tissue and the normally darker hand, and also printed with a lighter color, creating an enhanced masking effect having multiple colors on the paper product substrate. Printing with multiple inks can help mask the presence of dark and light regions corresponding to the fingers and spaces between the fingers beneath a wadded tissue having multiple thicknesses of thicknesses of tissue beneath the surface layer (e.g., some portions of the wadded or folded tissue may have 1 layer of tissue between the eyes and the hand, while other portions may have 2 or more layers—creating a multiplicity of apparent colors).

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. The process of applying at least one masking pattern to a paper product that is at least partially translucent, comprising:

a) providing a paper product having at least one ply that is at least partially translucent;

b) measuring at least one sample of said paper product with a meter for the values of L, a, and b of the HunterLab Color Scale;

c) measuring at least one human hand with a meter for the values of L, a, and b of the HunterLab Color Scale;

d) formulating an ink with a color using the HunterLab Color Scale in which L, a, and b for the ink which when printed on said paper product is in the range of the values:

$$L_{ink}+L_{tissue}+C1(L_{hand}-L_{tissue})$$

$$a_{ink}+a_{tissue}+C2(a_{hand}-a_{tissue})$$

$$b_{ink}+b_{tissue}+C3(b_{hand}-b_{tissue})$$

wherein $L_{tissue}$ and $L_{hand}$ are said meter measurements of at least one paper product sample and at least one hand reading respectively;

wherein $a_{tissue}$ and $a_{hand}$ are said meter measurements of at least one paper product sample and at least one hand reading respectively;

wherein $b_{tissue}$ and $b_{hand}$ are said meter measurements of at least one paper product sample and at least one hand reading respectively;

and wherein C1 is in the range from about −0.5 to about 1, and C2 and C3 each is in the range from 0 to about 1; and e) printing said formulated ink in a pattern on at least one ply of said paper product.

2. The process of claim 1 in which C1, C2 and C3 each is in the range from about 0 to about 1.

3. The process of claim 1 in which C1, C2 and C3 each is in the range from about 0 to about 0.75.

4. The process of claim 1 in which C1, C2 and C3 each is in the range from about 0 to about 0.5.

5. The process of claim 1 in which C1, C2 and C3 each is in the range from about 0.25 to about 0.5.

* * * * *